US009062488B2

(12) United States Patent
Sasaki

(10) Patent No.: US 9,062,488 B2
(45) Date of Patent: Jun. 23, 2015

(54) DOOR OPENING AND CLOSING DEVICE

(71) Applicant: MITSUI KINZOKU ACT CORPORATION, Yokohama-shi, Kanagawa (JP)

(72) Inventor: Kazuyuki Sasaki, Yokohama (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 29 days.

(21) Appl. No.: 14/092,465

(22) Filed: Nov. 27, 2013

(65) Prior Publication Data

US 2014/0144261 A1 May 29, 2014

(30) Foreign Application Priority Data

Nov. 27, 2012 (JP) ..... 2012-258933
Nov. 27, 2012 (JP) ..... 2012-259021

(51) Int. Cl.
*E05F 15/20* (2006.01)
*E05F 15/611* (2015.01)
*E05F 15/646* (2015.01)

(52) U.S. Cl.
CPC ..... *E05F 15/611* (2013.01); *Y10T 74/18568* (2015.01); *E05Y 2201/636* (2013.01); *E05Y 2201/72* (2013.01); *E05Y 2800/232* (2013.01); *E05Y 2900/531* (2013.01); *E05Y 2900/546* (2013.01); *E05F 15/646* (2015.01)

(58) Field of Classification Search
CPC ..... E05F 15/611; E05F 15/646
USPC ..... 296/146.4, 155, 56; 49/349
See application file for complete search history.

(56) References Cited

U.S. PATENT DOCUMENTS 6,055,775 A * 5/2000 Dering et al. ..... 49/340
7,147,267 B2 * 12/2006 Bittner et al. ..... 296/146.4
7,275,631 B2 * 10/2007 Hsieh ..... 192/226
7,665,794 B2 * 2/2010 Kachouh ..... 296/146.3
7,690,709 B2 * 4/2010 Barral et al. ..... 296/56
8,365,469 B2 * 2/2013 Kowalczyk et al. ..... 49/139

(Continued)

FOREIGN PATENT DOCUMENTS

DE 102005023542 A1 * 11/2006
JP 2005082019 A 3/2005

(Continued)

OTHER PUBLICATIONS

Machine Translation of DE102005023542A1 printed from the EPO website on Feb. 18, 2015.*

*Primary Examiner* — Jason S Morrow
(74) *Attorney, Agent, or Firm* — McDermott Will & Emery LLP

(57) ABSTRACT

A door opening and closing device includes: a motor; an output shaft configured to output power of the motor; a transmission mechanism configured to transmit the power of the motor to the output shaft; and an accommodation member configured to accommodate the motor and the transmission mechanism. The door opening and closing device is installed in a vehicle main body or a door supported by the vehicle main body in an openable and closable manner, thereby opening and closing the door by the power that is output from the output shaft. The accommodation member is cylindrical in shape, and the motor and the transmission mechanism are accommodated in the accommodation member so that the motor, the transmission mechanism, and the output shaft are arranged in an axial direction of a rotary shaft of the motor.

10 Claims, 10 Drawing Sheets

(56) References Cited

U.S. PATENT DOCUMENTS

| | | | | |
|---|---|---|---|---|
| 8,390,219 | B2 * | 3/2013 | Houser | 318/255 |
| 8,596,153 | B2 * | 12/2013 | Arenz | 74/89.23 |
| 8,677,689 | B1 * | 3/2014 | Draper et al. | 49/281 |
| 2005/0178066 | A1 * | 8/2005 | Drux et al. | 49/340 |
| 2006/0082186 | A1 * | 4/2006 | Bals | 296/146.1 |
| 2006/0103139 | A1 * | 5/2006 | Fronz et al. | 292/26 |
| 2007/0051046 | A1 * | 3/2007 | Yoshida | 49/345 |
| 2013/0169087 | A1 * | 7/2013 | Kummer | 310/76 |
| 2014/0373454 | A1 * | 12/2014 | Sasaki | 49/350 |

FOREIGN PATENT DOCUMENTS

| | | | |
|---|---|---|---|
| JP | 2005526199 | A | 9/2005 |
| WO | 03097979 | A1 | 11/2003 |

* cited by examiner

DOOR OPENING AND CLOSING DEVICE

CROSS-REFERENCE TO RELATED APPLICATIONS

The present application claims priority to and incorporates by reference the entire contents of Japanese Patent Application No. 2012-258933 filed in Japan on Nov. 27, 2012 and Japanese Patent Application No. 2012-259021 filed in Japan on Nov. 27, 2012.

BACKGROUND OF THE INVENTION

1. Field of the Invention

The present invention relates to a door opening and closing device.

2. Description of the Related Art

Some of back doors, slide doors or the like of vehicles are capable of being opened and closed by a door opening and closing device, in addition to the manual opening and closing. The door opening and closing device includes a motor, an output shaft configured to output the power of the motor, and a transmission mechanism configured to transmit the power of the motor to the output shaft. The door opening and closing device is installed in a vehicle main body or a door supported in the vehicle main body in an openable and closable manner, and causes the door to move by the power that is output from the output shaft in an opening direction or a closing direction.

As the transmission mechanism, a speed reduction mechanism, a clutch mechanism and the like are used (for example, see JP 2005-526199 W and JP 2005-082019 A). The speed reduction mechanism is configured to decelerate and output the power of the motor, and a planetary gear mechanism, a cycloid speed reduction mechanism or the like is used as the speed reduction mechanism. Furthermore, the clutch mechanism is configured to switch a state in which the output shaft is connected to the motor via the speed reduction mechanism or the like and a disconnected state. Switching of the clutch mechanism is controlled by a control unit, and when at least the door is opened and closed manually, the output shaft is disconnected from the motor. Accordingly, it is possible to prevent the rotation of the output shaft at the time of manually opening and closing the door from being transmitted to the motor, and it is possible to reduce the operating force at the time of the manual opening and closing.

Incidentally, a configuration and a combination of the transmission mechanism such as a speed reduction ratio of the speed reduction mechanism and the presence or absence of the clutch mechanism vary depending on the performance required for the door to which the door opening and closing device is applied. Furthermore, the relation between an axial direction of a rotary shaft of the motor and an axial direction of an output shaft varies depending on the installation position of the door opening and closing device. For that reason, according to the door opening and closing devices so far, an accommodation member has been designed in accordance with the configuration and the installation position of the transmission mechanism.

However, an external shape of the door opening and closing device has a shape and a dimension suitable for an application vehicle model. Therefore, when attempting the change of the installation position in the application vehicle model, and the installation to the vehicle model other than the vehicle model to be applied, some door opening and closing devices so far have not been fit to the installation space, and vehicle mountability has been low.

The present invention has been made in view of the above circumstances, and an object thereof is to provide a door opening and closing device with high vehicle mountability.

SUMMARY OF THE INVENTION

It is an object of the present invention to at least partially solve the problems in the conventional technology.

According to an aspect of the present invention, a door opening and closing device includes: a motor; an output shaft configured to output power of the motor; a transmission mechanism configured to transmit the power of the motor to the output shaft; and an accommodation member configured to accommodate the motor and the transmission mechanism, the door opening and closing device being installed in any one of a vehicle main body and a door supported by the vehicle main body in an openable and closable manner, thereby opening and closing the door by the power that is output from the output shaft. The accommodation member is cylindrical in shape, and the motor and the transmission mechanism are accommodated in the accommodation member so that the motor, the transmission mechanism, and the output shaft are arranged in an axial direction of a rotary shaft of the motor.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 10 is a schematic view of a case in which FIG. 9 is viewed from an upper side of a vehicle;

DETAILED DESCRIPTION OF THE PREFERRED EMBODIMENTS

Figure 1:
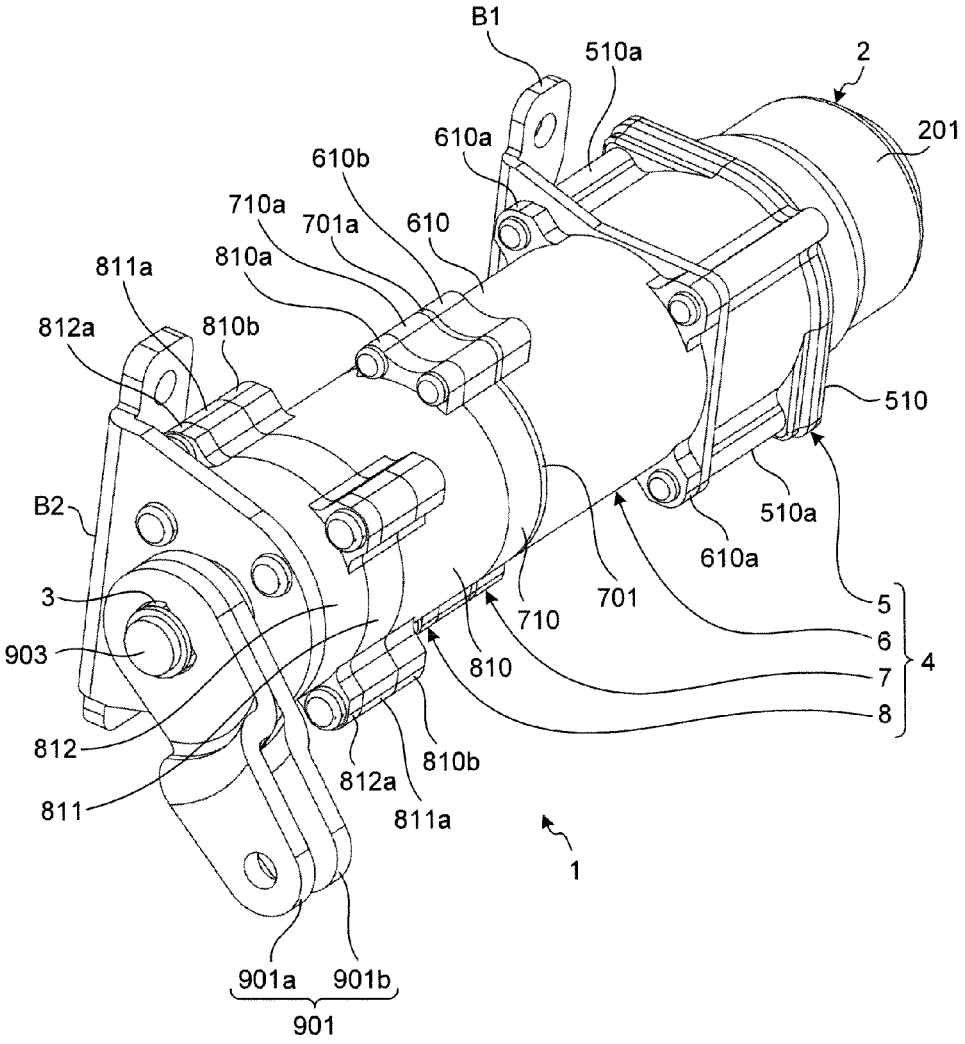
FIG. 1 is a perspective view illustrating an appearance of a door opening and closing device of a first embodiment of the invention.

Hereinafter, embodiments of the door opening and closing device according to the invention will be described in detail with reference to the drawings. In the whole drawings for describing the embodiments, parts having the same functions are denoted by the same reference numerals, and the repetitive description thereof will not be provided.

First Embodiment

Figure 2:
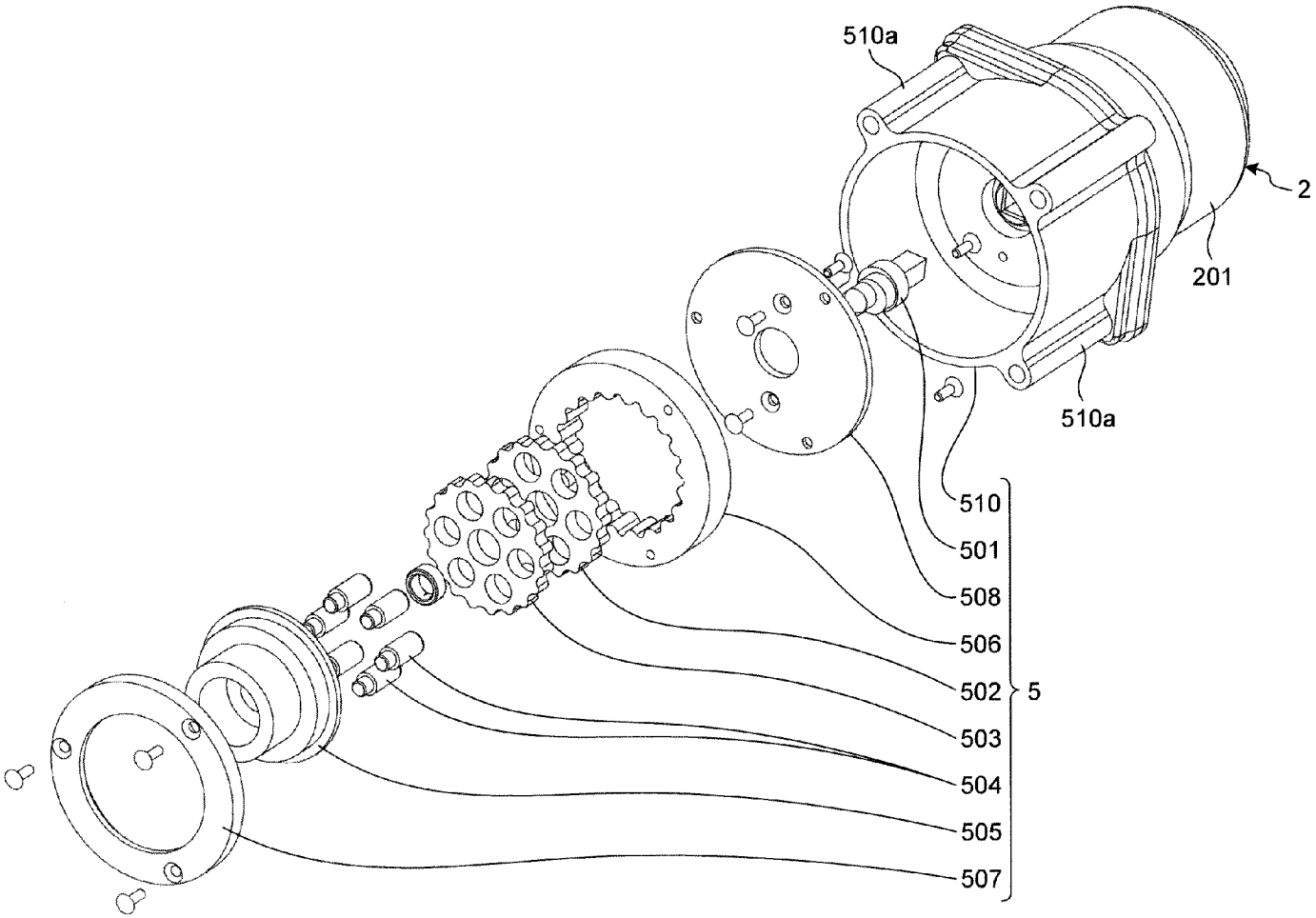
FIG. 2 is an exploded perspective view illustrating a configuration of a cycloid speed reduction mechanism in the door opening and closing device of FIG. 1.
Figure 3:
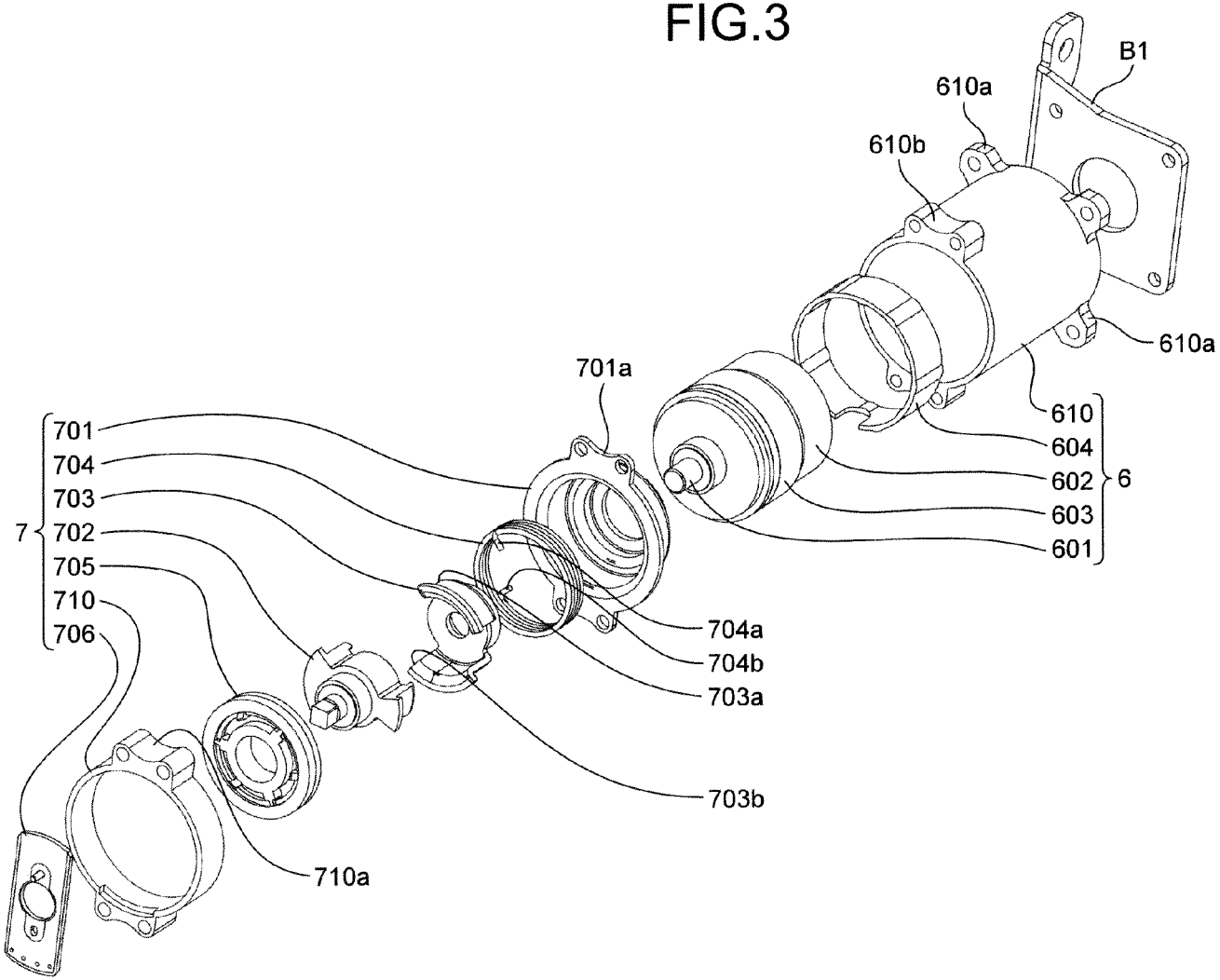
FIG. 3 is an exploded perspective view illustrating a configuration of a clutch mechanism and a brake mechanism in the door opening and closing device of FIG. 1.
Figure 4:
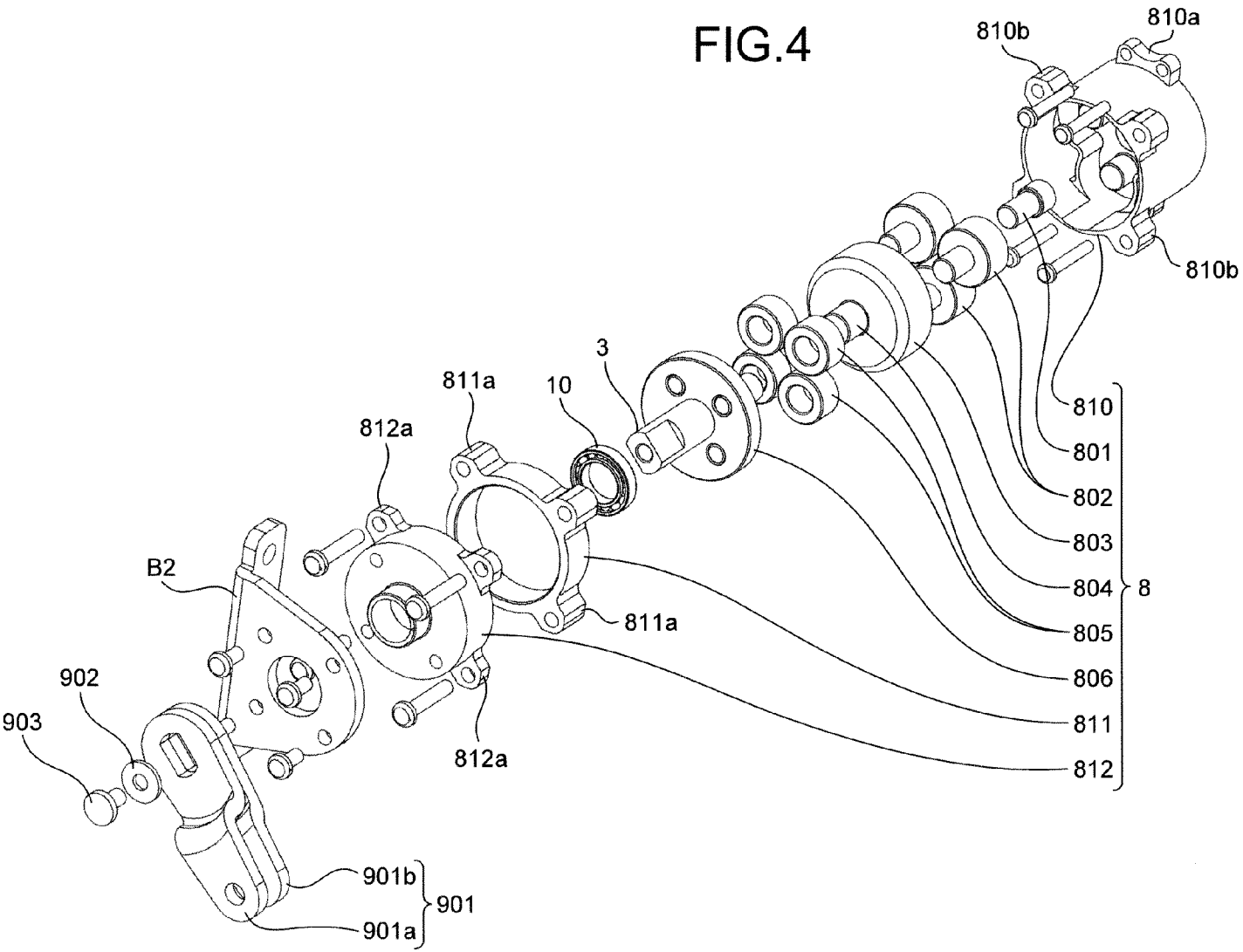
FIG. 4 is an exploded perspective view illustrating a configuration of a planetary gear mechanism in the door opening and closing device of FIG. 1.

FIG. 1 is a perspective view illustrating an appearance of a door opening and closing device of the first embodiment of the invention. FIG. 2 is an exploded perspective view illustrating a configuration of a cycloid speed reduction mechanism in the door opening and closing device of FIG. 1. FIG. 3 is an exploded perspective view illustrating a configuration of a clutch mechanism and a brake mechanism in the door opening and closing device of FIG. 1. FIG. 4 is an exploded perspective view illustrating a configuration of a planetary gear mechanism in the door opening and closing device of FIG. 1.

The door opening and closing device according to the first embodiment is configured to electrically open and close a back door, a slide door, or the like of a vehicle. As illustrated in FIG. 1, a door opening and closing device 1 includes a motor 2, an output shaft 3, and a transmission mechanism 4. Furthermore, as illustrated in FIGS. 1 to 4, the transmission mechanism 4 includes a cycloid speed reduction mechanism 5, a clutch mechanism 6, a brake mechanism 7, and a planetary gear mechanism 8.

The motor 2 is configured to generate power for opening and closing the door, and a rotor, an electromagnet or the like (not illustrated) are accommodated in a cylindrical motor case 201 as an accommodation member. The electromagnet is connected to a power supply circuit (not illustrated). The output shaft 3 is configured to output the power for opening and closing the door, and is connected to a rotary shaft of the motor 2 via the transmission mechanism 4. A lever 901 (901*a*, 901*b*) for transmitting the power that is output for opening and closing the door to the door or the vehicle main body via the opening and closing member is attached to the output shaft 3. The lever 901 is attached by inserting a screw 903 through a mounting hole (not illustrated) with a washer 902 interposed therebetween, and by screwing the screw 903 and the mounting hole (not illustrated) of the output shaft 3.

The transmission mechanism 4 is configured to transmit the power of the motor 2 to the output shaft 3. The cycloid speed reduction mechanism 5, the clutch mechanism 6, the brake mechanism 7, and the planetary gear mechanism 8 are sequentially arranged from the motor 2 side in the axial direction of the rotary shaft of the motor 2.

The cycloid speed reduction mechanism 5 is a first speed reduction mechanism that decelerates and outputs the power that is input from the motor 2. As illustrated in FIG. 2, the cycloid speed reduction mechanism 5 includes a crank shaft 501, a first planetary gear 502, a second planetary gear 503, a shaft 504, a planetary carrier 505, a ring gear 506, a first cover 507, and a second cover 508. The above described components are accommodated and unitized in a cylindrical gear case 510 as an accommodation member. The gear case 510 is fixed to the motor case 201, by screwing a fixing ear portion 510*a* provided on an outer peripheral surface and the motor case 201.

The crank shaft 501 is a rotary shaft that transmits the power from the motor 2 to the first planetary gear 502 and the second planetary gear 503. The crank shaft 501 and the first planetary gear 502 are connected to each other such that the rotary axis of the first planetary gear 502 is eccentric from the rotary axis of the motor 2. The crank shaft 501 and the second planetary gear 503 are connected to each other such that the rotary axis of the second planetary gear 503 is eccentric from the rotary axis of the motor 2 and the eccentric direction is different from the first planetary gears 502. The first planetary gear 502 and the second planetary gear 503 are connected to the planetary carrier 505 via the shaft 504. The ring gear 506 is a gear that engages with the first planetary gear 502 and the second planetary gear 503. The first planetary gear 502, the second planetary gear 503, and the planetary carrier 505 are maintained in a relatively rotatable manner with the ring gear 506 by the first cover 507 and the second cover 508. At this time the ring gear 506 is fixed to the gear case by fixing the second cover 508 to the gear case 510. Accordingly, when the crank shaft 501 rotates, the first planetary gear 502, the second planetary gear 503, and the planetary carrier 505 rotate.

In addition, the cycloid speed reduction mechanism 5 is configured such that the crank shaft 501 and the planetary carrier 505 rotate at the same rotary axis.

The clutch mechanism 6 is configured to perform switching of a state in which the output shaft 3 is connected to the motor 2, and a state in which the output shaft 3 is disconnected from the motor 2. In the first embodiment, an electromagnetic clutch is used as the clutch mechanism 6. As illustrated in FIG. 3, the clutch mechanism 6 includes an input shaft (not illustrated) as an input member, an output shaft 601 as an output member, an electromagnet portion 602, a connection portion 603, and a spacer 604. The above described components are accommodated and unitized in a cylindrical clutch case 610 as a cylindrical accommodation member. By screwing and fixing a fixing ear portion 610*a* provided on the outer peripheral surface of the clutch case 610 and a fixing ear portion 510*a* provided on the outer peripheral surface of the gear case 510 of the cycloid speed reduction mechanism 5, the clutch case 610 is fixed to the gear case 510 (See FIG. 1). At this time, a bracket B1 as a fixing member for fixing the door opening and closing device 1 to the vehicle main body or the door is interposed between the clutch case 610 and the gear case 510.

The input shaft of the clutch mechanism 6 is connected to the planetary carrier 505 of the cycloid speed reduction mechanism 5. Furthermore, the output shaft 601 of the clutch mechanism 6 is connected to a brake plate 703 of a brake mechanism 7 as will be described later. At this time, the input shaft is provided with an electromagnet portion 602, and the output shaft 601 is provided with a connection portion 603 made of a metallic material. The clutch mechanism 6 connects the electromagnet portion 602 to a control circuit (not illustrated), and when a current is applied to the electromagnet portion 602 from the control circuit, the connection portion 603 is fixed to the electromagnet portion 602. Furthermore, when the current is not applied to the electromagnet portion 602, the connection portion 603 is away from the electromagnet portion 602. Thus, a state in which the output shaft 3 (the output shaft 602 of the clutch mechanism 6) of the door opening and closing device 1 is connected to the motor 2 and a state in which the output shaft 3 of the door opening and closing device 1 is disconnected from the motor 2 are switched. In the door opening and closing device 1 according to the embodiment, the clutch mechanism 6 is controlled so that when the motor 2 is not operated, the output shaft 3 is in a state of being disconnected from the cycloid speed reduction mechanism 5 and the motor 2, and when the motor 2 is operated, the output shaft 3 is in a state of being connected to the motor 2.

In addition, the clutch mechanism 6 is configured such that the input shaft and the output shaft 601 rotate at the same rotary axis.

The brake mechanism 7 is configured to hold the opened door between a closed position and a maximum open position. In the first embodiment, a spring-type brake mechanism is used as the brake mechanism 7. As illustrated in FIG. 3, the brake mechanism 7 includes a base 701, a brake block 702, a brake plate 703, a brake spring 704, and magnetic sensors 705 and 706, and these components are accommodated and unitized in the base 701 and a cylindrical brake case 710 as the accommodation member. The base 701 and the brake case 710 are fixed to the first clutch case 610 and a first gear case 810, by screwing and fixing a fixing ear portion 701*a* provided on the outer periphery of the base 701 and a fixing ear portion 710*a* provided on the outer peripheral surface of the brake case 710 with a fixing ear portion 610*b* provided on the outer peripheral surface of the clutch case 610 of the clutch mechanism 6 and a fixing ear portion 810*a* provided in the first gear case 810 of the planetary gear mechanism 8 to be described below (see FIG. 1).

The base 701 is a cover member that accommodates the brake spring 704 or the like, and the outer diameter portion of the brake spring 704 comes into contact with the inner diameter portion of the base 701 during non-operation. The outer diameter portion of the brake spring 704 and the inner diameter portion of the base 701 are configured such that frictional force with the magnitude capable of holding the position of the opened door is generated by the contact therebetween. Furthermore, the brake block 702 is connected to a first sun gear 801 of the planetary gear mechanism 8 to be described below, and the brake plate 703 is connected to the output shaft 601 of the clutch mechanism 6. The brake block 702 and the brake plate 703 rotate at the same rotary axis.

When the brake mechanism 7 operates the motor 2, the brake plate 703 connected to the output shaft 601 of the clutch mechanism 6 rotates, and the brake block 702 rotates by the rotation of the brake plate 703. At this time, the brake plate 703 presses a pressed portion 704*a* (or 704*b*) of the brake spring 704 by a pressing portion 703*a* (or 703*b*), and deforms the brake spring 704 so as to shrink in the radial direction. Thus, the frictional force between the outer diameter portion of the brake spring 704 and the inner diameter portion of the base 701 is reduced, which makes it possible to open and close the door with the small power of the motor 2.

Meanwhile, when the door is manually opened and closed, in the brake mechanism 7, the brake block 702 rotates, and the brake plate 703 rotates by the rotation of the brake block 702. At this time, the brake block 702 presses the pressed portion 704*a* (or 704*b*) of the brake spring 704 by a pressing portion (not illustrated), and deforms the brake spring 704 so as to expand in the radial direction. Thus, in the case of opening and closing the door manually, the frictional force between the outer diameter portion of the brake spring 704 and the inner diameter portion of the base 701 increases. However, since this frictional force has the magnitude of the degree that the door does not fall in the closing direction by its own weight, the operation force at the time of opening and closing the door manually does not become heavier remarkably. In addition, it is possible to suppress the movement speed of the door due to the action of the frictional force when opening and closing the door manually, and it is possible to reduce the impact when the door stops at the closed position or the maximum open position.

Furthermore, the magnetic sensors 705 and 706 are open and close state detection unit that detects the opened or closed state of the door. One magnetic sensor 705 rotates together with the brake block 702, and the other magnetic sensor 706 is fixed to the brake case 710. By detecting the opened or closed state of the door with the magnetic sensors 705 and 706, for example, when the door approaches the closed position or the maximum open position at the time of opening and closing the door with the power of the motor 2, it is possible to slow down the movement speed of the door, and reduce the impact when the door stops at the closed position or the maximum open position.

The planetary gear mechanism 8 is a second speed reduction mechanism that decelerates and outputs the power that is input from the cycloid speed reduction mechanism 5 via the clutch mechanism 6 and the brake mechanism 7. In the first embodiment, the planetary gear mechanism 8 is constituted by a two-stage planetary gear mechanism. As illustrated in FIG. 4, the planetary gear mechanism 8 includes the first sun gear 801, a first planetary gear 802, a first ring gear 803, a second sun gear 804, a second planetary gear 805, and a second planetary carrier 806. The above described components are accommodated and unitized in a cylindrical accommodation member that includes the first gear case 810, a second gear case 811, and an end member 812. Furthermore a bracket B2, as a fixing member for fixing the door opening and closing device 1 to the vehicle main body or the door, is attached to the end member 812. In FIG. 4, teeth of the gear in the planetary gear mechanism 8 are not illustrated.

The first sun gear 801 is connected to the brake block 702 of the brake mechanism 7, and engages with the first planetary gear 802. The first planetary gear 802 is rotatably supported by the first gear case 810. In other words, the first gear case 810 has the function as the first planetary carrier to the first planetary gear 802. The first ring gear 803 engages with the first planetary gear 802, and turns by the rotation of the first planetary gear 802. The second sun gear 804 is connected to the first ring gear 803.

The second sun gear 804 is connected to the first ring gear 803 and engages with the second planetary gear 805. The second planetary gear 805 is rotatably supported by the second planetary carrier 806. Furthermore, the second planetary gear 805 engages with an internal gear that is provided on the inner peripheral surface of the second gear case 811. That is, the second gear case 811 has a function as a second ring gear to the second planetary gear 805. In addition, the output shaft 3 of the door opening and closing device 1 is connected to the second planetary carrier 806. The output shaft 3 is supported to the end member 812 via a bearing 10.

When the first sun gear 801 turns; the first planetary gear 802 rotates. The first gear case 810 configured to support the first planetary gear 802 is one of the accommodation members that accommodate the transmission mechanism 4, and is fixed to the motor case 201 via the brake case 710 or the like. For that reason, when the first planetary gear 802 rotates, the first ring gear 803 and the second sun gear 804 turn. When the second sun gear 804 turns; the second planetary gear 805 rotates. The second ring gear engaged with the second planetary gear 805 is provided in the second gear case 811. The second gear case 811 is one of the accommodation members that accommodate the transmission mechanism 4, and is fixed to the motor case 201 via the first gear case 810 or the like. For that reason, the second planetary gear 805 rotates and revolves. That is, when the second sun gear 804 turns, the second planetary carrier 806 and the output shaft 3 of the door opening and closing device 1 turn. Therefore, when the first sun gear 801 turns; the output shaft 3 of the door opening and closing device 1 turns.

In addition, the planetary gear mechanism 8 is configured such that the first sun gear 801 and the second planetary carrier 806 (the output shaft 3 of the door opening and closing device 1) turn at the same rotary axis.

In the door opening and closing device 1 according to the first embodiment, as described above, the cycloid speed reduction mechanism 5 is used as one of the speed reduction mechanisms for decelerating the power of the motor 2. For that reason, compared to a case in which the whole speed reduction mechanism is configured by a planetary gear mechanism, the door opening and closing device 1 can obtain the large reduction ratio, and it is possible to reduce the size in the axial direction and the radial outward direction in the rotary shaft of the motor 2.

Furthermore, the door opening and closing device 1 according to the first embodiment connects the output shaft 3 and the motor 2 by the clutch mechanism 6 in the case of electrically opening and closing the door, and transmits the power of the motor 2 to the output shaft 3. On the other hand, when the output shaft 3 turns in a state in which the motor 2 is not operated; the output shaft 3 is disconnected from the cycloid speed reduction mechanism 5 and the motor 2 by the clutch mechanism 6. For that reason, when the output shaft 3 turns by opening and closing the door manually, the rotation is not transmitted to the cycloid speed reduction mechanism 5. Therefore, the cycloid speed reduction mechanism 5 does not become the resistance of the rotation of the output shaft 3 when the door is opened or closed manually, and it is possible to lighten the operating force of the manual door opening and closing operation.

In addition, since the cycloid speed reduction mechanism 5 having a large reduction ratio is used as one of the speed reduction mechanisms, it is possible to reduce the speed reduction ratio of the planetary gear mechanism 8 provided between the clutch mechanism 6 and the output shaft 3 of the door opening and closing device 1. For that reason, the resistance due to the planetary gear mechanism 8 when the door is opened or closed manually is reduced, and the operating force of the manual door opening and closing operation is suppressed from becoming heavier. In addition, by providing the planetary gear mechanism 8 between the clutch mechanism 6 and the output shaft 3, as compared to the case in which the clutch mechanism 6 is provided between the planetary gear mechanism 8 and the output shaft 3, it is possible to reduce the transmission force of the clutch mechanism 6. For that reason, the size of the clutch mechanism 6 can be reduced.

Furthermore, since the brake mechanism 7 is provided between the clutch mechanism 6 and the output shaft 3 of the door opening and closing device 1, even in a state in which the output shaft 3 is disconnected from the motor 2, it is possible to hold the door between the closed position and the maximum open position. In addition, since the clutch mechanism 6 and the brake mechanism 7 are provided so as to be adjacent to each other, for example, when the force in the closing direction due to the own weight, the force in the opening direction due to gas stay or the like acts on the output shaft 3, even if the holding force required to maintain the position of the door is small, it is possible to maintain the position of the door. For that reason, downsizing of the brake mechanism 7 is possible.

Moreover, in the door opening and closing device 1 of the first embodiment, the accommodation member for accommodating the motor 2 and the transmission mechanism 4 is cylindrical in shape, and the motor 2, the transmission mechanism 4, and the output shaft 3 are accommodated so as to be parallel to the axial direction of the rotary shaft of the motor 2. For that reason, the external shape of the door opening and closing device 1 has a rod shape as illustrated in FIG. 1. Since the door opening and closing device 1 having such an external shape is easily installed in a space having small dimensional difference depending on the vehicle models, such as the vehicle main body and the corner portion of the door, it is possible to perform the change of the installation position and the application to the multiple vehicle models, and the vehicle mountability is high. Furthermore, the vehicle main body and the corner portion of the door are portions that are formed by bending a metal plate and thus have high strength compared to the flat portion. For that reason, it is possible to reduce the size of the brackets B1, B2 for installing the door opening and closing device 1 in the vehicle main body or the door, and the vehicle mountability further increases.

Next, the installation example of the door opening and closing device 1 according to the first embodiment will be described.

Figure 5:
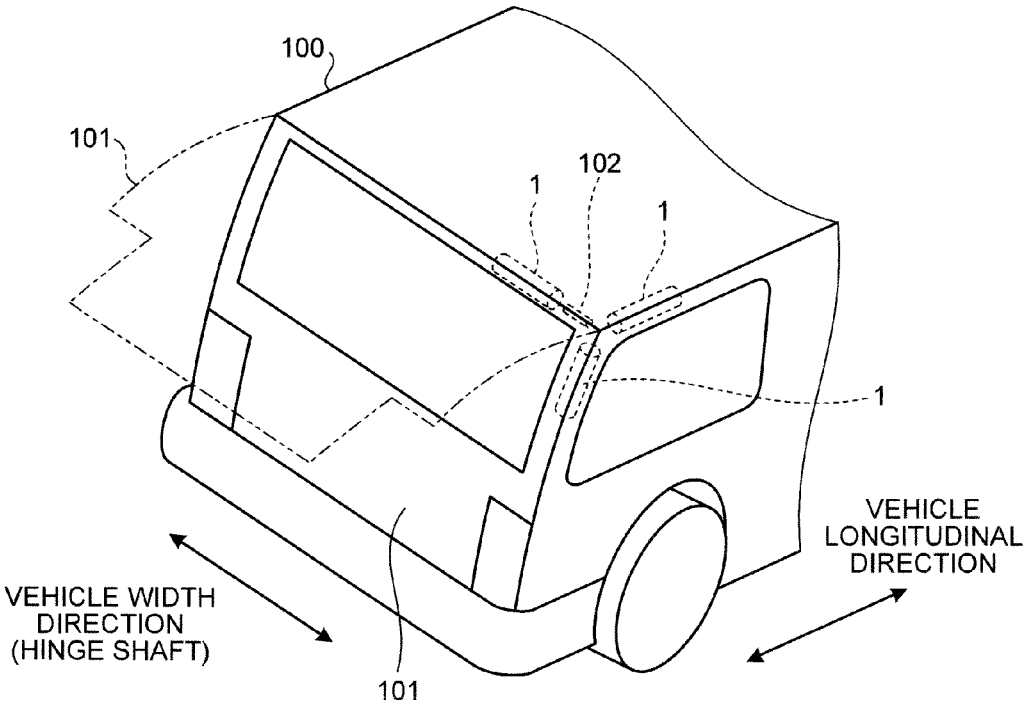
FIG. 5 is a schematic view illustrating an installation example of a case in which the door opening and closing device according to the first embodiment is used for opening and closing of a back door.
Figure 6:
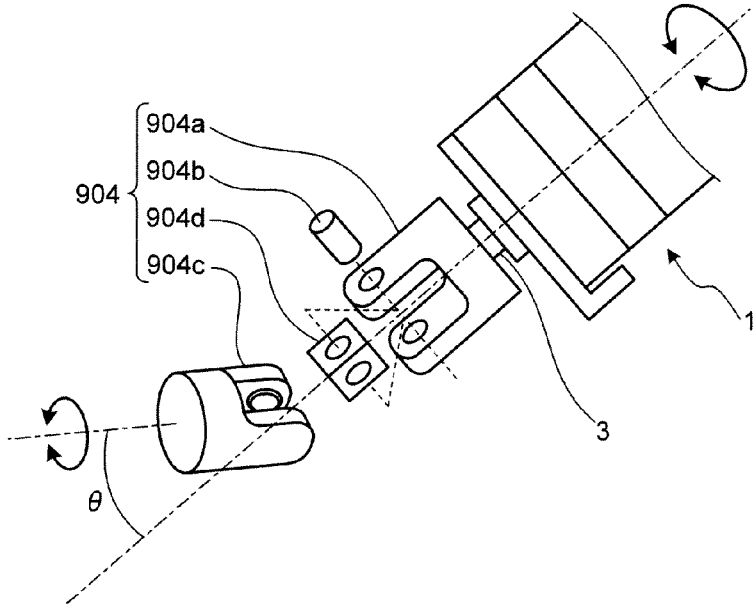
FIG. 6 is a schematic diagram illustrating an example in which a universal joint is attached to an output shaft.
Figure 7:
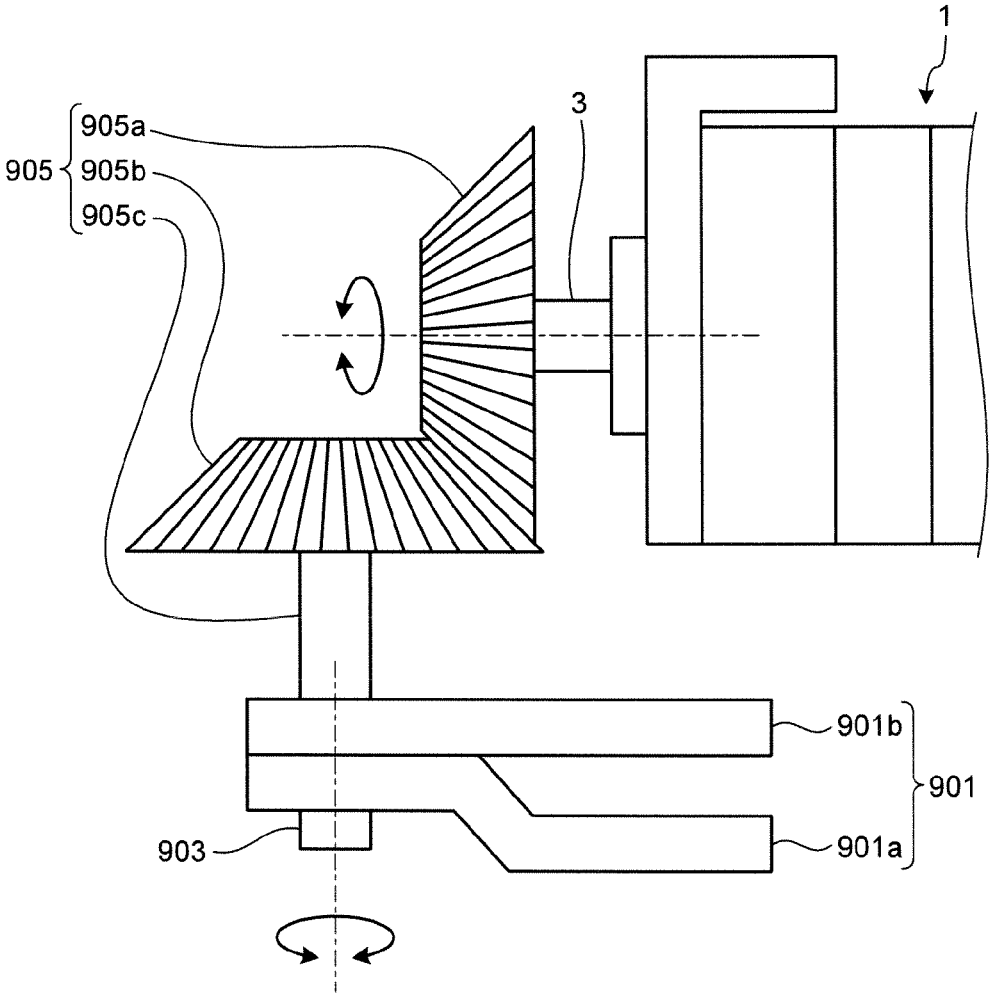
FIG. 7 is a schematic diagram illustrating an example in which a bevel gear is attached to the output shaft.
Figure 8:
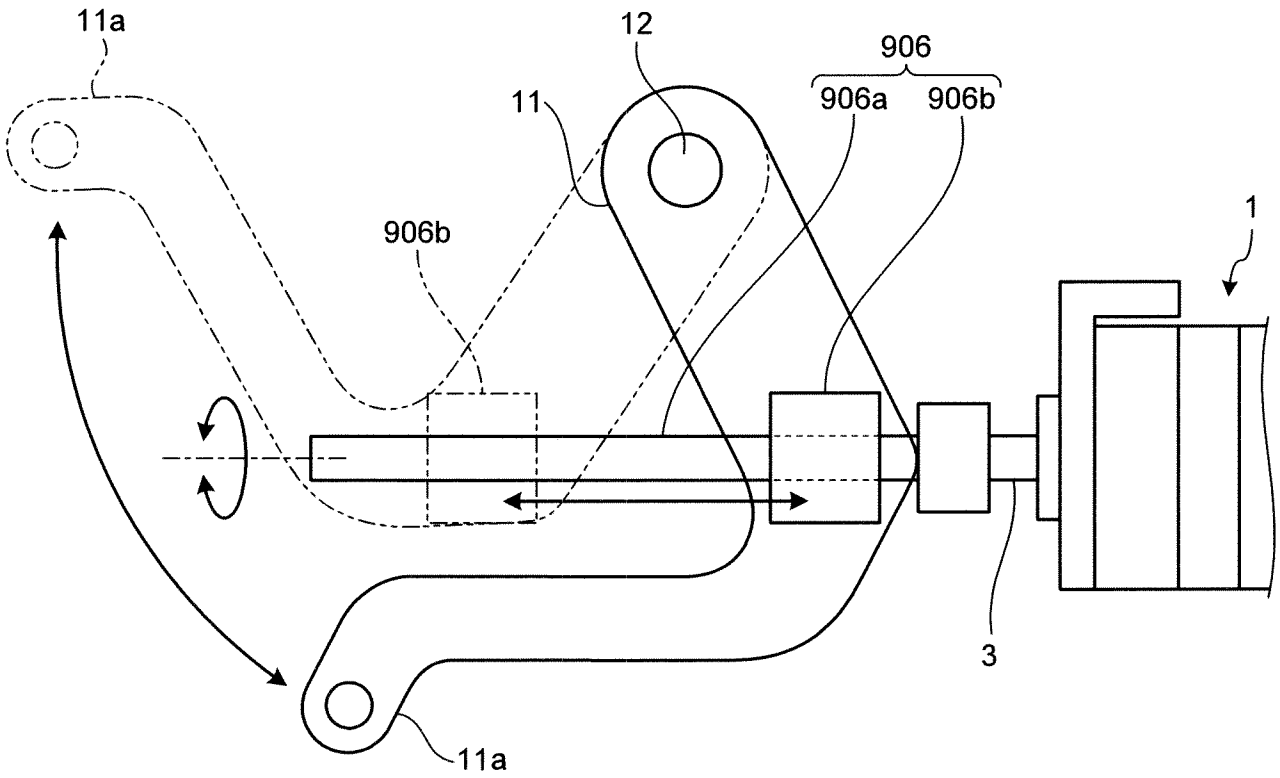
FIG. 8 is a schematic diagram illustrating an example in which a spindle is attached to the output shaft.

FIG. 5 is a schematic view illustrating an installation example of a case in which the door opening and closing device according to the first embodiment is used for opening and closing the back door. FIG. 6 is a schematic diagram illustrating an example in which a universal joint is attached to the output shaft. FIG. 7 is a schematic diagram illustrating an example in which the bevel gear is attached to the output shaft. FIG. 8 is a schematic diagram illustrating an example in which a spindle is attached to the output shaft.

The door opening and closing device 1 according to the first embodiment has an external shape of a rod shape as described above. For that reason, in a case in which the door opening and closing device 1 is used for opening and closing the back door, for example, it is possible to select and install one of the positions illustrated in FIG. 5. That is, it is possible to install the door opening and closing device 1 so that the rotary axis of the output shaft 3 goes along the installation surface, in the corner portion of the roof in a vehicle main body 100 and a rear pillar (a C-pillar and a D-pillar) extending toward the lower side of the vehicle from the roof of the rearmost portion of the vehicle. Furthermore, in the case of installing the door opening and closing device 1 along the corner portion of the roof in the vehicle main body 100, the installation is not limited to a vehicle width direction along the axis (hinge axis) of a hinge 102 configured to connect the vehicle main body 100 and a back door 101, and it is also possible to install the door opening and closing device 1 so as to extend along the longitudinal direction of the vehicle. In such a door opening and closing device 1, it is desirable that member other than the lever 901 illustrated in FIG. 1 be configured in an attachable manner to the output shaft 3. That is, it is desirable that the output shaft 3 of the door opening and closing device 1 according to the first embodiment be configured so that an opening and closing member for opening and closing the door and the connection mechanism (lever 901 or the like) for connecting the opening and closing member and the output shaft 3 can be selectively attached thereto.

When the lever 901 as illustrated in FIG. 1 is attached to the output shaft 3, the rotary axis of the lever 901 coincides with the rotary axis of the output shaft 3. For that reason, the door opening and closing device 1 with the lever 901 attached to the output shaft 3 is suitable for being installed so that the direction of the rotary axis of the output shaft 3 becomes a vehicle width direction along the axis of the hinge 102.

Furthermore, the output shaft 3 may preferably have a configuration capable of attaching a universal joint 904 as illustrated in FIG. 6, in addition to the lever 901. The universal joint 904 is a member in which first shaft connection portions 904*a* and 904*b* and a second shaft connection portion 904*c* are connected by a connection member 904*d*. The first shaft connection portions 904*a* and 904*b* and the second shaft connection portion 904*c* are configured so that an angle θ of the mutual rotary axis can have an arbitrary value. Therefore, by attaching the universal joint 904 to the output shaft 3, the rotation of the output shaft 3 can be converted into the rotation in the rotary axis in a direction different from the rotary axis of the output shaft 3. Furthermore, by using two universal joints 904, the rotary axis of the output shaft 3 and the rotary axis of the hinge shaft can be set to a relation parallel to each other and spaced apart by a predetermined distance. For that reason, when the door opening and closing device 1 is installed in the vehicle width direction along the axis of the hinge 102, there is no need to install the door opening and closing device 1 so that the output shaft 3 and the hinge shaft turn at the same rotary axis, and the degree of freedom for installation position increases.

Furthermore, as illustrated in FIG. 7, the output shaft 3 may preferably have a configuration capable of attaching an axial direction conversion mechanism 905 thereto. The axial direction conversion mechanism 905 includes a first bevel gear 905*a*, a second bevel gear 905*b*, and a rotary shaft 905*c*. The axial direction conversion mechanism 905 attaches the first bevel gear 905*a* to the output shaft 3 of the door opening and closing device 1, and engages the second bevel gear 905*b* attached to the rotary shaft 905*c* with the first bevel gear 905*a*. Thus, when the output shaft 3 of the door opening and closing device 1 turns; the rotary shaft 905*c* turns via the first bevel gear 905*a* and the second bevel gear 905*b*. At this time, the rotary axis of the rotary shaft 905*c* is converted in a direction orthogonal to the rotary axis of the output shaft 3. For that reason, when the output shaft 3 turns, the lever 901 attached to the rotary shaft 905*c* turns at the rotary axis orthogonal to the rotary axis of the output shaft 3. Such a configuration is suitable for installing the door opening and closing device 1 so that the direction of the rotary axis of the output shaft 3 becomes the longitudinal direction of the vehicle or the vertical direction of the vehicle.

Furthermore, as illustrated in FIG. 8, the output shaft 3 may preferably have a configuration capable of attaching a motion conversion mechanism 906 thereto. The motion conversion mechanism 906 is configured to convert the rotary motion output from the output shaft 3 of the door opening and closing device 1 into the linear motion along the central axis direction, and includes a spindle 906*a* and a spindle nut 906*b*. The motion conversion mechanism 906 attaches the spindle 906*a* to the output shaft 3 of the door opening and closing device 1, and attaches the spindle nut 906*b* to a hinge 11. The hinge 11 is supported by a hinge shaft 12 so as to turn in the direction orthogonal to the central axis direction of the output shaft 3, and causes a door connection portion 11*a* to pivot by turning at the hinge shaft 12. When the output shaft 3 of the door opening and closing device 1 and the spindle 906*a* turn: the spindle nut 906*b* moves along the rotary axis of the spindle 906*a*; and the hinge 11 turns. Thus, the door connection portion 11*a* of the hinge 11 pivots, and the door is opened or closed. Such a configuration is suitable for installing the door opening and closing device 1 so that direction of the rotary axis of the output shaft 3 becomes the longitudinal direction of the vehicle or the vertical direction of the vehicle.

In addition, the door opening and closing device according to the first embodiment can also be used for opening and closing the slide door provided on the side portion of the vehicle main body 100, without being limited to the back door 101.

Figure 9:
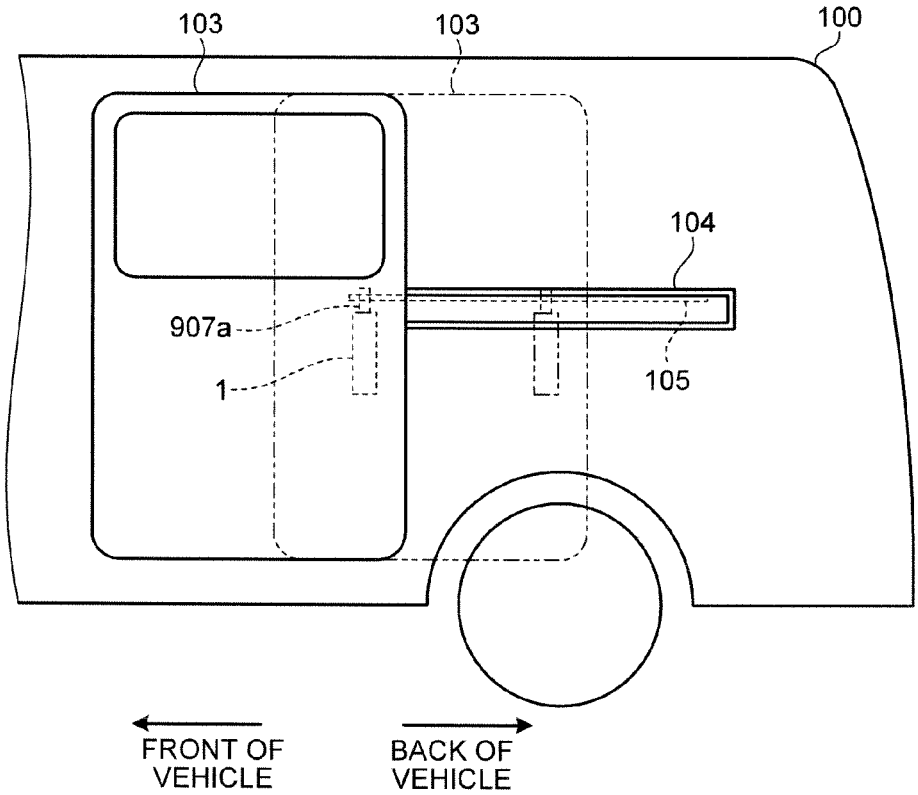
FIG. 9 is a schematic view illustrating an installation example of a case in which the door opening and closing device according to the first embodiment is used for opening and closing of a slide door.
Figure 10:
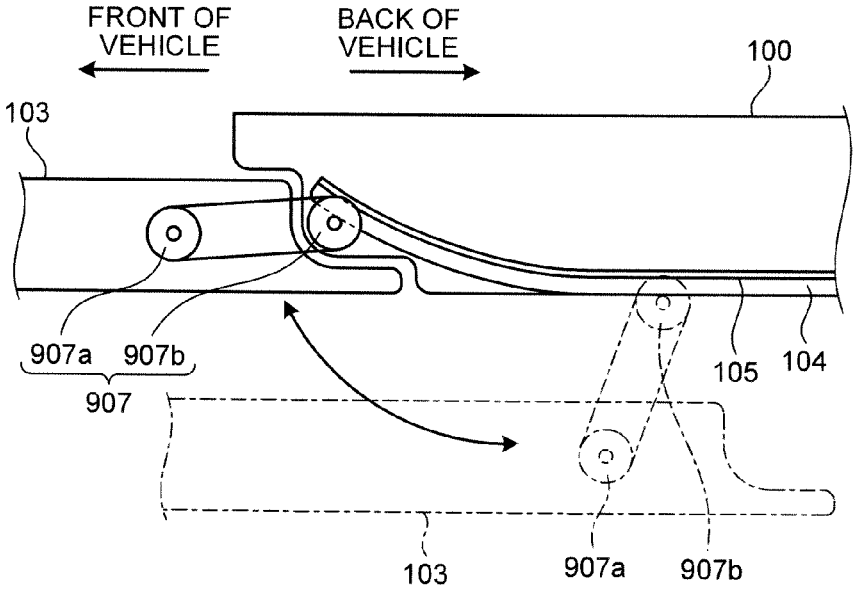

FIG. 9 is a schematic view illustrating an installation example of a case in which the door opening and closing device according to the first embodiment is used for the opening and closing of the slide door. FIG. 10 is a schematic diagram in which FIG. 9 is viewed from the upper side of the vehicle.

A slide door 103 moves in the longitudinal direction of the vehicle along a guide rail 104 that is provided on the vehicle main body 100. When the door opening and closing device 1 according to the first embodiment is used for opening and closing the slide door, for example, as illustrated in FIGS. 9 and 10, the door opening and closing device 1 is installed inside the slide door 103. The door opening and closing device 1 is installed so that direction of the rotary axis of the output shaft 3 becomes the vertical direction of the vehicle, and a first rotary drum 907*a* is attached to the output shaft 3. The first rotary drum 907*a* is attached so as to turn at the rotary axis of the output shaft 3. When opening and closing the slide door 103 using the door opening and closing device 1, a cable 105 provided along the guide rail 104 is sent out while winding up by the first rotary drum 907*a* and a second rotary drum 907*b*. Thereby, the slide door 103 moves along the guide rail 104. In addition, the rotary axes of the first rotary drum 907*a* and the second rotary drum 907*b* may be converted into a direction orthogonal to the rotary axis of the output shaft 3 using, for example, the axial direction conversion mechanism 905 described above.

In this way, according to the door opening and closing device 1 of the first embodiment, the vehicle mountability is further improved, by the configuration capable of selectively attaching the opening and closing member for opening and closing the door, and the connection mechanism (the lever 901, the universal joint 904, the axial direction conversion mechanism 905, the motion conversion mechanism 906, the rotary drums 907*a* and 907*b* or the like) for connecting the opening and closing member and the output shaft 3 to the output shaft 3.

Second Embodiment

Figure 11:
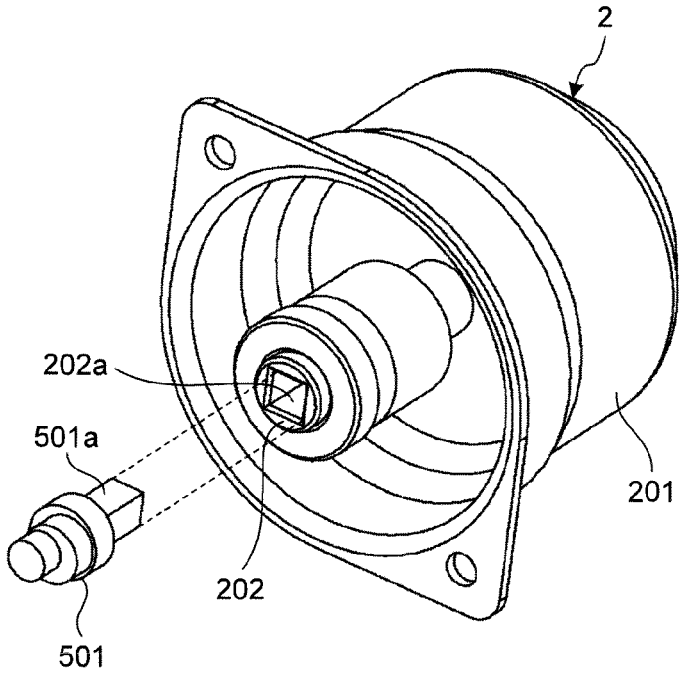
FIG. 11 is an exploded perspective view illustrating a configuration of a connection portion between a rotary shaft of a motor and a crank shaft of a cycloid speed reduction mechanism in a door opening and closing device of a second embodiment of the invention.
Figure 12:
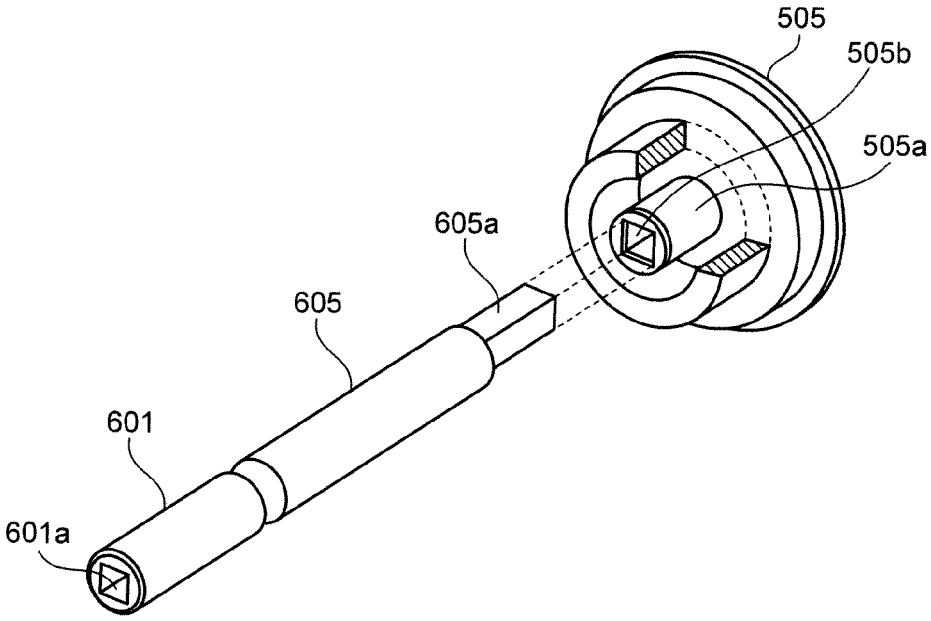
FIG. 12 is an exploded perspective view illustrating a configuration of a connection portion between a planetary carrier of the cycloid speed reduction mechanism and an input shaft of a clutch mechanism in the door opening and closing device according to the second embodiment.

FIG. 11 is an exploded perspective view illustrating a configuration of a connection portion between a rotary shaft of a motor and a crank shaft of a cycloid speed reduction mechanism in a door opening and closing device according to a second embodiment of the invention. FIG. 12 is an exploded perspective view illustrating a configuration of a connection portion between a planetary carrier of the cycloid speed reduction mechanism and an input shaft of a clutch mechanism in the door opening and closing device according to the second embodiment.

In the second embodiment, a configuration for allowing the transmission mechanism 4 in the door opening and closing device 1 according to the first embodiment to cope with various required performances. Here, various required performances are performances required for the door to which the door opening and closing device 1 is applied, and, for example, there is a configuration of the speed reduction mechanism, the presence or absence of the clutch mechanism 6, and the presence or absence of the brake mechanism 7 or the like.

In the door opening and closing device 1 according to the second embodiment, in order to allow the transmission mechanism 4 to cope with various required performances, it is possible to easily change the combination of the unitized mechanism of the cycloid speed reduction mechanism 5, the clutch mechanism 6, the brake mechanism 7, and the planetary gear mechanism 8. For that reason, the connection forms of the input member and the output member between the unitized mechanisms are matched. For example, as illustrated in FIG. 11, the crank shaft 501 and a rotary shaft 202 of the motor 2 serving as the input members of the cycloid speed reduction mechanism 5 fit and connect a fitting convex portion 501*a* provided on the crank shaft 501, and a fitting concave portion 202*a* provided on the rotary shaft 202. Furthermore, as illustrated in FIG. 12, the planetary carrier 505 serving as an output member of the cycloid speed reduction mechanism 5 and an input shaft 605 serving as an input member of the clutch mechanism 6 fit and connect a fitting convex portion 605*a* provided on the input shaft 605 and a fitting concave portion 505*b* provided on a connection portion 505*a* of the planetary carrier 505. Furthermore, at this time, the fitting concave portion 505*b* of the planetary carrier 505 has a shape capable of also being fitted to the fitting convex portion 501*a* provided on the crank shaft 501. Thus, the fitting convex portion 605*a* of the input shaft 605 of the clutch mechanism 6 to be fitted to the fitting concave portion 505*b* of the planetary carrier 505 of the cycloid speed reduction mechanism 5 can also be fitted to the fitting concave portion 202*a* of the rotary shaft 202 of the motor 2. In addition, the fitting convex portion and the fitting concave portion have shapes that are fitted in a manner capable of transmitting the power.

Similarly, the output shaft 601 serving as an output member of the clutch mechanism 6 is provided with a fitting concave portion 601*a* that can be fitted to the fitting convex portion provided on the input member of the brake mechanism 7 which is not illustrated, and the fitting convex portion 605*a* of the input shaft 605 of the clutch mechanism 6. Thus, the fitting convex portion provided on the input member of the brake mechanism 7 can also be fitted to the fitting concave portion 505*b* of the planetary carrier 505 of the cycloid speed reduction mechanism 5 and the fitting concave portion 202*a* of the rotary shaft 202 of the motor 2.

Thus, in the door opening and closing device 1 according to the second embodiment, the fitting convex portion provided on the input member and the fitting concave portion provided on the output member in each mechanism unitized are fitted to connect the mechanisms. At this time, the output shaft 3 of the door opening and closing device 1 is provided with a fitting convex portion that is capable of being fitted to any one of a fitting concave portion of: a second planetary carrier 806 serving as an output member of the planetary gear mechanism 8; a fitting concave portion of the brake block 702 serving as an output member in the brake mechanism 7; the fitting concave portion 601*a* of the output shaft 601 serving as an output member of the clutch mechanism 6; the fitting concave portion 505*b* of the planetary carrier 505 serving as an output member in the cycloid speed reduction mechanism 5; and the fitting concave portion 202*a* of the rotary shaft 202 serving as an output member of the motor 2. Furthermore, each unitized mechanism is configured so that the input member and the output member turn at the same rotary axis, the fitting convex portion of the input member can be fitted to the fitting concave portion of the output member. For that reason, in the door opening and closing device 1 according to the second embodiment, for example, it is possible to easily change the arrangement sequence of the cycloid speed reduction mechanism 5, the clutch mechanism 6, the brake mechanism 7, and the planetary gear mechanism 8. Furthermore, by changing the configuration of the transmission mechanism 4, the door opening and closing device 1 according to the second embodiment is easily constituted, for example, only by the cycloid speed reduction mechanism 5 and the clutch mechanism 6.

Figure 13:
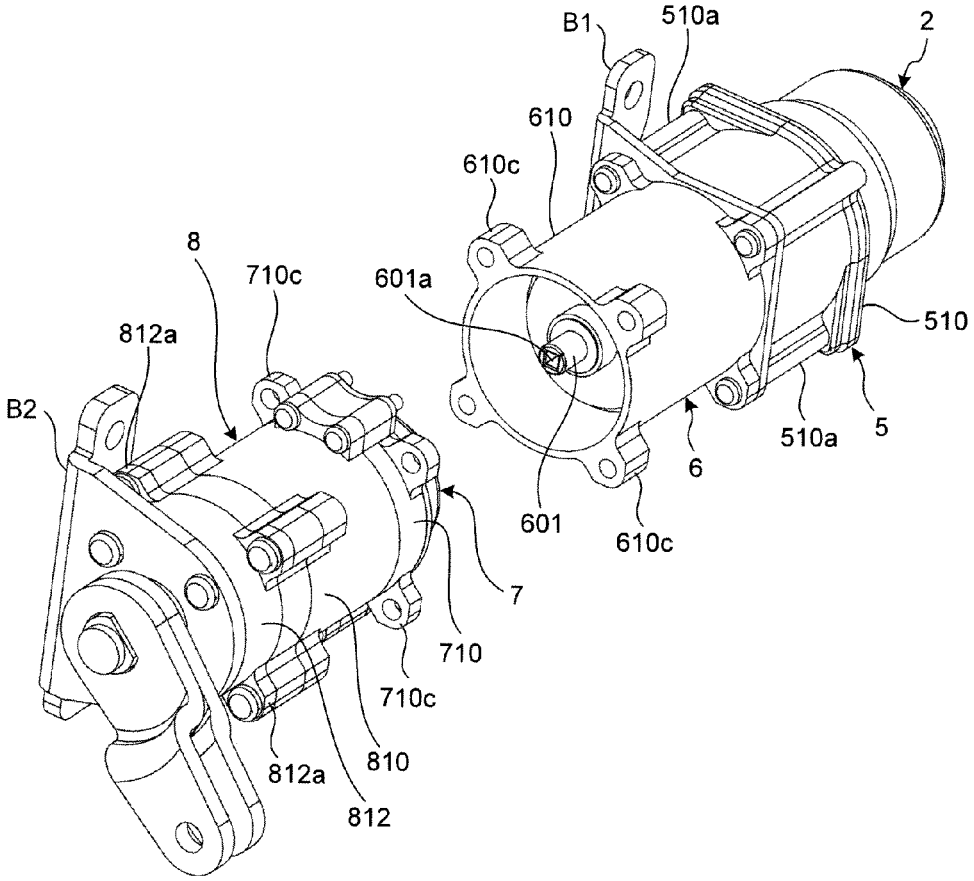
FIG. 13 is a perspective view illustrating a configuration example of an accommodation member in the door opening and closing device according to the second embodiment.

FIG. 13 is a perspective view illustrating a configuration example of an accommodation member in a door opening and closing device according to the second embodiment.

In a case in which the unitized mechanisms are combined to configure the transmission mechanism 4 as in the door opening and closing device 1 according to the second embodiment, it is preferable not only to match the connection forms of the input member and the output member between the mechanisms, but also to match the connection form between the cases as the accommodation member. For example, as illustrated in FIG. 13, in the clutch case 610 of the clutch mechanism 6, a fixing ear portion 610*c* is also provided in the end portion of the output side on the outer peripheral surface. The fixing ear portion 610*c* of the clutch case 610 is provided in a manner capable of being screwed with a fixing ear portion 812*a* of an end member 812. Thus, it is possible to constitute the transmission mechanism 4 of the door opening and closing device 1, only by the cycloid speed reduction mechanism 5 and the clutch mechanism 6.

Furthermore, as illustrated in FIG. 13, as long as a fixing ear portion 710*c* capable of being screwed with a fixing ear portion 812*a* of the end member 812 is provided on the outer peripheral surface of the brake case 710 of the brake mechanism 7, it is possible to constitute the transmission mechanism 4 by three mechanisms including the cycloid speed reduction mechanism 5, the clutch mechanism 6, and the brake mechanism 7. Furthermore, although not illustrated, as long as a fixing ear portion capable of being screwed with the fixing ear portion 610*c* of the clutch case 610 of the clutch mechanism 6 is provided in the end portion of the input side of the first gear case 810 of the planetary gear mechanism 8, it is possible to constitute the transmission mechanism 4 by three mechanisms including the cycloid speed reduction mechanism 5, the clutch mechanism 6, and the planetary gear mechanism 8.

In this manner, in a case in which the transmission mechanism 4 provided between the motor 2 and the output shaft 3 has a configuration in which the unitized mechanisms are arranged, the size in the rotary axis direction changes depending on the number and the configuration of the mechanisms included in the transmission mechanism 4. In a case in which the transmission mechanism 4 is constituted only by the cycloid speed reduction mechanism 5 and the clutch mechanism 6, the size of the door opening and closing device 1 in the rotary axis direction decreases. In a case in which the door opening and closing device 1 having the small size in the rotary axis direction is installed in the vehicle main body or the corner portion of the door, it may be enough to use only the bracket B2 attached to the end member 812. In that case, the bracket B1 may not be interposed between the gear case 510 of the cycloid speed reduction mechanism 5 and the clutch case 610 of the clutch mechanism 6. That is, it is possible to selectively provide the fixing member, by constituting the transmission mechanism 4 by the combination of the unitized mechanisms and by attaching the fixing member (brackets B1 and B2) different from the accommodation member to the accommodation member.

Furthermore, the door opening and closing device 1 according to the second embodiment, the size in the rotary axis direction varies depending on the configuration of the transmission mechanism 4, but the size in the outer radial direction hardly changes. For that reason, in a case in which the door opening and closing device 1 is installed so that the rotary axis goes along the installation surface as illustrated in FIGS. 5 and 9, it is possible to cope with various required performances, without damaging the vehicle mountability.

Although the embodiments of the door opening and closing device 1 according to the invention have been described above, the invention is not limited to the configurations illustrated in the above embodiments, and the invention can suitably be changed without departing from the scope and spirit thereof.

For example, the cycloid speed reduction mechanism 5 is not limited to the configuration illustrated in FIG. 2, but may have other configurations. Further, the speed reduction mechanism connected to the motor 2 is not limited to the cycloid speed reduction mechanism 5 but may be a planetary gear mechanism.

Furthermore, the clutch mechanism 6 is not limited to the electromagnetic clutch, but may have other configurations. Furthermore, the brake mechanism 7 is not limited to the spring-like illustrated in FIG. 3, but may have other configurations. Moreover, it is also possible to use a speed reduction mechanism using a spur gear in place of the planetary gear mechanism 8.

Furthermore, in the second embodiment, although the fitting convex portion of the input member and the fitting concave portion of the output member in the unitized mechanisms are fitted to each other to connect the mechanisms, as long as the power can be transmitted, the connection may be performed by a method different from fitting.

According to the door opening and closing device according to the invention, an accommodation member configured to accommodate the motor and the transmission mechanism is cylindrical in shape, and the motor and the driving mechanism are accommodated in the accommodation member so that the motor, the speed reduction mechanism, and the output shaft are arranged in an axial direction of the rotary shaft of the motor. According to such a door opening and closing device, since the external shape thereof is a rod shape, it is easy to perform the installation thereof to a small space having a small size difference depending on the vehicle models, such as the vehicle main body and corner portions of the door, and it is possible to perform the change of the installation position and the application to multiple vehicle models. Therefore, it is possible to enhance the vehicle mountability of the door opening and closing device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door opening and closing device comprising:

a motor;

an output shaft configured to output power of the motor;

a transmission mechanism configured to transmit the power of the motor to the output shaft; and an accommodation member configured to accommodate the motor and the transmission mechanism, the door opening and closing device being installed in any one of a vehicle main body and a door supported by the vehicle main body in an openable and closable manner, thereby opening and closing the door by the power that is output from the output shaft, wherein the accommodation member is cylindrical in shape, and the motor and the transmission mechanism are accommodated in the accommodation member so that the motor, the transmission mechanism, and the output shaft are arranged in an axial direction of a rotary shaft of the motor.

2. The door opening and closing device according to claim 1, wherein the rotary shaft of the motor and the output shaft can be fitted in the state in which the power is transmitted, the transmission mechanism has an input member configured to input the power, and an output member configured to output the power, the input member and the output member are configured so as to rotate at the same rotary axis, the input member of the transmission mechanism and the rotary shaft of the motor are fitted in the state in which the power is transmitted, the output member of the transmission mechanism and the output shaft are fitted in the state in which the power is transmitted, and a fitting portion with the rotary shaft of the motor in the input member of the transmission mechanism is capable of being fitted to a fitting portion with the output shaft in the output member of the transmission mechanism.

3. The door opening and closing device according to claim 1, wherein the transmission mechanism includes a speed reduction mechanism that decelerates and outputs the power of the motor.

4. The door opening and closing device according to claim 1, wherein the transmission mechanism includes:

a cycloid speed reduction mechanism that decelerates and outputs the power of the motor; and a clutch mechanism that switches a state in which the output shaft is connected to the motor via the cycloid speed reduction mechanism, and a state in which the output shaft is disconnected from the motor, wherein the clutch mechanism is provided between the cycloid speed reduction mechanism and the output shaft, and when the output shaft is rotated at least in a state in which the motor is not operated, the output shaft enters a state of being disconnected from the cycloid speed reduction mechanism.

5. The door opening and closing device according to claim 1, wherein the transmission mechanism includes a clutch mechanism that switches a state in which the output shaft is connected to the motor and a state in which the output shaft is disconnected from the motor.

6. The door opening and closing device according to claim 5, wherein the transmission mechanism includes a speed reduction mechanism that decelerates and outputs the power of the motor, and the speed reduction mechanism is provided between the clutch mechanism and the output shaft.

7. The door opening and closing device according to claim 1, wherein the transmission mechanism includes a brake mechanism that maintains the position of the opened door.

8. The door opening and closing device according to claim 1, wherein the transmission mechanism includes an opening and closing state detecting unit that detects the opened or closed state of the door.

9. The door opening and closing device according to claim 1, wherein a portion of the accommodation member that accommodates the transmission mechanism is connected to a plurality of cylindrical cases in the axial direction of the rotary shaft of the motor.

10. The door opening and closing device according to claim 1, wherein a fixing member configured to fix the accommodation member to any one of the vehicle main body and the door is attached to the accommodation member.

* * * * *